United States Patent [19]

Baumeister et al.

[11] 4,000,801

[45] Jan. 4, 1977

[54] PRINT WIRE ATTACHMENT

[75] Inventors: Heard Kilpatrick Baumeister, Durham; Robert Allen Sebrosky; Walter Rudolph Wagner, both of Raleigh, all of N.C.

[73] Assignee: International Business Machines Corporation, Armonk, N.Y.

[22] Filed: Nov. 10, 1975

[21] Appl. No.: 630,225

Related U.S. Application Data

[63] Continuation of Ser. No. 425,344, Dec. 17, 1973, abandoned.

[52] U.S. Cl. ..... 197/1 R; 101/93.05

[51] Int. Cl.[2] ..... B41J 3/04

[58] Field of Search ..... 197/1 R; 101/93.04, 101/93.05, 93.32, 93.33, 93.34, 93.48; 335/274, 275, 278, 270

[56] References Cited

UNITED STATES PATENTS

| | | | |
|---|---|---|---|
| 3,672,482 | 6/1972 | Brumbaugh et al. | 197/1 R |
| 3,828,908 | 8/1974 | Schneider | 197/1 R |
| 3,836,880 | 9/1974 | Matschke et al. | 197/1 R X |
| 3,876,050 | 4/1975 | Linder | 197/1 R |
| 3,892,175 | 7/1975 | Heindke et al. | 197/1 R X |
| 3,896,918 | 7/1975 | Schneider | 197/1 R |

*Primary Examiner*—Ralph T. Rader
*Attorney, Agent, or Firm*—Edward H. Duffield

[57] ABSTRACT

An improved means for attaching print wires in a wire matrix print head mechanism is disclosed which enables the use of brittle wire materials having long wear life, such as tungsten carbide, to be attached to a moving armature in a manner which eliminates or reduces the flexural stresses so that the wires will not be broken in use. A flexural hinge means is utilized to connect the moving armature to the printing wire, the hinge being of a unitary piece of high strength, flexible material having a lower stiffness than the printing wire.

2 Claims, 3 Drawing Figures

PRINT WIRE ATTACHMENT

This is a continuation of application Ser. No. 425,344 filed Dec. 17, 1973, now abandoned.

FIELD OF THE INVENTION

This invention relates generally to wire matrix printing heads and apparatus and more specifically to the means for attaching wire matrix print wires to the driving armatures which move the wires to effect printing.

PRIOR ART

A great many wire matrix print head devices have been built in the past and have become well known in the field of printing. Examples of such devices are shown in U. S. Pat. Nos. 3,592,311, 3,627,096, 3,217,640, 3,108,534, 3,584,575, 3,467,232, and 3,690,431 to mention only a few.

The aforementioned prior art can be characterized along the lines that the wire matrix printing wires are either moved longitudinally by a sliding armature which is moved by concentric or linearly placed magnets so that no bending stresses are applied to the driving end of the wire or, the moving armature is attached rigidly to the wire and is mounted on a flexible leaf spring so that it is driven back and forth in a small arc when it is attracted to a magnetic pole piece such as is shown in U.S. Pat. No. 3,592,311 for example.

The linear actuating devices which have a solenoid and an armature which moves longitudinally within the field of the solenoid impart little or no bending or flexural stresses to the end of the wire where it is attached to the moving armature. These devices, however, are more expensive to construct and maintain, require closer tolerances in manufacture and generally tend to be more bulky in size than is acceptable in many applications.

The type of print head in which the armature is mounted on a flexible leaf spring overcomes some of the problems with the design utilizing a linear reciprocating armature, but incurs flexural or bending stresses in the end of the wire which is attached to the armature. This is so since, as the spring moves back and forth in a slight arc, the junction between the armature and the print wire rotates slightly, thereby inducing flexural stresses. Breakage may be incurred because of fatigue, which is initiated by high stresses induced by the higher modulus of elasticity in the print wire materials.

It has been known that hard and impact resistant materials such as tungsten carbide alloys could be utilized as wire matrix printing members, but attempts to embody these materials in printing heads such as shown in U.S. Pat. No. 3,592,311 ended in failure prematurely because the brittle wire materials fractured at or near the junction with the armature due to the bending stresses induced during operation.

OBJECTS OF THE INVENTION

In light of the foregoing difficulties with the prior art, it is an object of the present invention to provide improved means for attaching brittle wire printing material to an arcuately moving armature in a manner which reduces or eliminates bending stresses.

It is also an object of this invention to provide an improved printing head embodying hard and brittle wire printing members which are mounted to resist breakage due to flexural stresses, thereby producing a new and improved head having longer life and greater utility than the previous previously known devices of this type.

SUMMARY OF THE INVENTION

The foregoing and other objects of the invention are met by providing a flexible unitary hinge means for joining the driven end of the hard brittle wire to the arcuately moving armature in a print head of a general design as shown in U.S. Pat. No. 3,592,311. In one preferred form of the invention, the hinge comprises a piece of steel tubing which is flattened in the horizontal and vertical planes and which is attached to the printing wire and to the moving armature. The flattened tubing bears the flexural stresses by bending to accommodate a small arcuate displacement. It thus serves as a hinge linking the armature to the print wire.

BRIEF DESCRIPTION OF THE DRAWINGS

Turning to FIG. 1, a preferred embodiment of the invention will be described. As shown in FIG. 1, an individual print wire 1 passes through guide tube means 2 from the printing end of wire 1, not shown. One end of wire 1 is swaged into the end of a hinge means 3, although it could be brazed, welded, adhesively fixed, pinned, etc., as desired. Hinge 3 comprises a piece of thin steel tubing which has been flattened in both vertical and horizontal planes 4 and 5. The other end of hinge 3 is rigidly attached to a spring 6 which is fixedly mounted in a mount 7. This type of structure including spring 6 and mount 7 is typically shown in U.S. Pat. No. 3,592,311, assigned to the Assignee of the present invention, which for the purposes of description, is made a part hereof as an example of one print head structure in which the present invention finds utility.

An armature 8 is attached to the other face of spring 6 and is positioned adjacent a pole piece 9 which forms the central core of an electromagnet 10 as is shown in the aforementioned U.S. Pat. No. 3,592,311.

Figure 1:
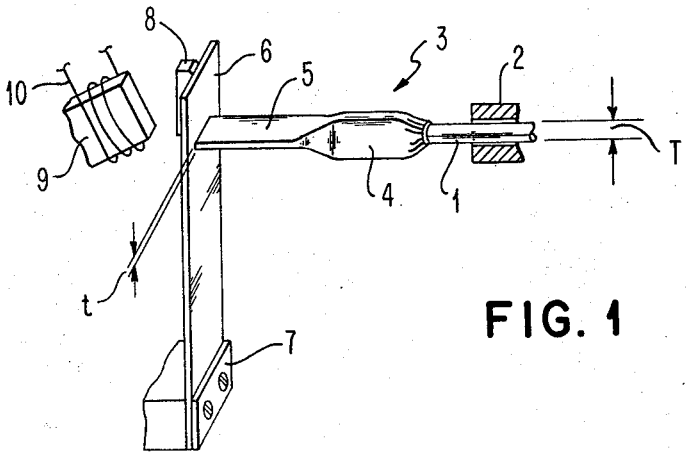
FIG. 1 illustrates in schematic form a side view of a preferred embodiment of the present invention.

The electromagnetic core 9 and the coil 10 are also fixed in position relative to spring 6 and armature 8. When printing is desired, in this design, the flux through the armature is removed, thereby releasing armature 8 under the impetus of spring 6 and driving the wire 1 to the right as shown in FIG. 1. At the end of the printing stroke, the flux 10 is again applied attracting armature 8 against pole piece 9 and holding it in a fixed position until the next so-called "wire fire."

Figure 3:
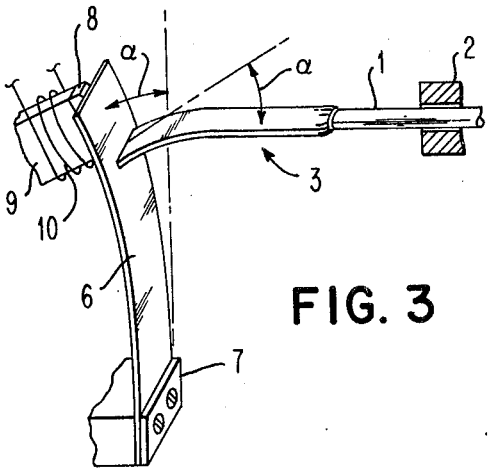
FIG. 3 illustrates the action of the improved attachment means of the present invention in overcoming or reducing flexural stresses in the wire.

Turning to FIG. 3, the operation during one wire fire is shown in which the bending stresses induced in the end of wire 1 are being taken up by the flexible hinge 3, principally in its flattened horizontal segment 5.

In FIG. 3, armature 8 is attracted against pole piece 9 and there can be seen an angle of flexure, $\alpha$, which is imparted to the flattened portion 5 of hinge 3 which is the same as the angle of deflection $\alpha$ of spring 6.

It has been found advantageous to incorporate a flattened vertical portion 4 in hinge 3 to take up any stray flexural stresses in the horizontal plane whereas the flattened portion 5 in the horizontal plane takes up any flexural stresses in the vertical plane as shown. The hinge member 3 is made of a unitary piece of steel tubing which is welded, swaged or brazed to spring 6 after it is flattened and swaged, press-fitted or brazed to the end of wire 1. As shown in FIG. 1, the thickness *t* of the flattened portion 5 and of flattened portion 4 of hinge 3 are less than the thickness T of the wire 1. This fact, taken together with the fact that the material of hinge 3 has a lower modulus of elasticity than that of wire 1 forces all, or nearly all, of the bending strain to be absorbed in the flexible hinge 3 as described.

It has been found most advantageous to make hinge 3 of steel approximately 0.003 inches in thickness through the wall which is flattened to a total thickness *t* through the regions 5 and 4 of approximately 0.006 inches. The length of the flattened portion in one embodiment of the invention is approximately 0.37 inches, and the thickness T of the wire 1, actually its diameter, is approximately 0.011 inches. Wire 1 is made of a tungsten carbide material commercially known as Walmet Corp. grade No. WA–119.

Figure 2:
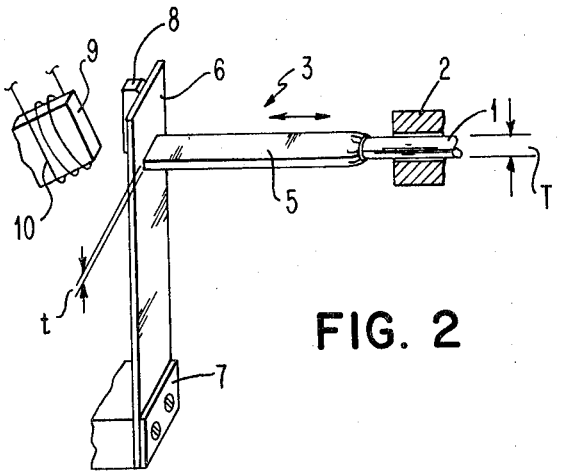
FIG. 2 illustrates another embodiment of the present invention.

Another embodiment of the invention is illustrated in FIG. 2 in which the vertical flattened portion 4 of hinge 3 has been omitted with the hinge being made of one flattened piece of tubing flattened in the horizontal plane 5. This has been found specifically useful in the type of driver means and geometry illustrated as in FIG. 1 where little or no strain in the horizontal plane need be accommodated. Its operation is essentially identical with that of the embodiment in FIG. 1 wherein the energizing means comprising the coil 10 together with core 9 and armature 8 and spring 6 and mount 7 is energized to load spring 6 for a wire fire. When printing of the particular wire is desired, the current through coil 10 is turned off by means not shown thereby allowing the release of stored energy in spring 6 to drive the wire 1 to the right.

It is anticipated that a variety of materials other than the specific steel tubing chosen for hinge 3 could be utilized to advantage in the present invention. For example, it is well known that the so-called "living hinge" propylene plastic materials can stand up to repeated flexure without breaking and it is possible that hinge 3 could be manufactured of a single piece of such material suitably fastened via adhesive or other means to the end of wire 1 and to the spring 6. Also such well known flexible and springy material such as spring steel, phosphor bronze, etc., could be utilized to take up the horizontal and vertical bending stresses and act as a unitary hinge between the driving means and the wire 1.

For use with the tungsten carbide material of the preferred embodiment, physical parameters of the particular hinge material chosen should be a cold drawn, precipitation hardening martensitic stainless steel, half hard temper. This tubing material is cut to length, formed, and hardened 4 hours at 900° F in vacuum. A commercial grade, made by Carpenter Steel Co., is custom No. 455.

While the invention has been particularly shown and described with reference to a preferred embodiment thereof, it will be understood by those skilled in the art that various changes may be made herein without departing from the spirit and scope of the invention.

What is claimed is:

1. In wire matrix print head apparatus having an electromagnetic wire driving means for reciprocating the wire between an operative print position and a retracted position, said driving means being adapted to move in a slightly arcuate path, thereby producing thrusting and bending movements and further having means connecting said thrusting and bending motions of said driving means to said wire, the improvement comprising:

said connecting means is a unitary flexible hinge of a single piece of material directly connecting said driving means to said wire means, said connecting means having at least a first portion thereof that is more flexible in the plane of bending induced in said wire by said driving means than said wire alone in said same plane of bending, thereby reducing said bending moment induced in said wire.

2. Apparatus as described in claim 1, wherein:

said hinge means further includes a second portion having a greater flexibility than said wire means, said second portion of said hinge being disposed in a plane perpendicular to the plane of flexibility in bending of said first flexible portion of said hinge means.

* * * * *